US010022031B2

(12) United States Patent
Bruders et al.

(10) Patent No.: US 10,022,031 B2
(45) Date of Patent: Jul. 17, 2018

(54) POWER/WATER SUPPLY AND RECLAMATION TANK FOR CLEANING DEVICES, AND ASSOCIATED SYSTEMS AND METHODS

(71) Applicant: Dri-Eaz Products, Inc., Burlington, WA (US)

(72) Inventors: William Bruders, Sedro Woolley, WA (US); Brett Bartholmey, Bellingham, WA (US)

(73) Assignee: Dri-Eaz Products, Inc., Burlington, WA (US)

( * ) Notice: Subject to any disclaimer, the term of this patent is extended or adjusted under 35 U.S.C. 154(b) by 255 days.

(21) Appl. No.: 14/542,479

(22) Filed: Nov. 14, 2014

(65) Prior Publication Data

US 2015/0136176 A1 May 21, 2015

Related U.S. Application Data

(60) Provisional application No. 61/905,050, filed on Nov. 15, 2013.

(51) Int. Cl.
*B08B 3/00* (2006.01)
*A47L 11/40* (2006.01)
(Continued)

(52) U.S. Cl.
CPC ..... *A47L 11/4083* (2013.01); *A47L 11/145* (2013.01); *A47L 11/161* (2013.01);
(Continued)

(58) Field of Classification Search
CPC ..... A47L 11/4083; A47L 11/4072; A47L 11/4002; A47L 11/4075; A47L 11/145;
(Continued)

(56) References Cited

U.S. PATENT DOCUMENTS 1,211,948 A 1/1917 Koster et al.
1,498,255 A 6/1924 Winchester
(Continued)

FOREIGN PATENT DOCUMENTS

JP 2002311192 A 10/2002
WO WO-0106188 A1 1/2001
WO WO-2005118959 A1 12/2005

OTHER PUBLICATIONS

International Search Report and Written Opinion for International Patent Application No. PCT/US2014/065824, Applicant: Dri-Eaz Products, Inc., dated Apr. 6, 2015, 16 pages.
(Continued)

*Primary Examiner* — Eric W Golightly
(74) *Attorney, Agent, or Firm* — Perkins Coie LLP

(57) ABSTRACT

A portable power and water supply for hard surface or carpet cleaners is disclosed. The portable power and water supply can include a portable platform with a fresh/waste water tank and two or more power connectors that can be coupled to separate power sources. The fresh/waste water tank can have an internal bladder that separates fresh cleaning water from returned waste water. The fresh/waste water tank can facilitate operation of cleaning tools (e.g., hard surface cleaners and/or carpet cleaners) in buildings with limited or widely spaced water supplies, without the need for long hoses. The power connectors can be coupled to wall power to direct power to the cleaning tools.

9 Claims, 14 Drawing Sheets

(51) Int. Cl.

| | |
|---|---|
| ***B08B 3/10*** | (2006.01) |
| ***A47L 11/14*** | (2006.01) |
| ***A47L 11/16*** | (2006.01) |
| ***A47L 11/162*** | (2006.01) |
| ***A47L 11/20*** | (2006.01) |
| ***A47L 11/293*** | (2006.01) |
| ***A47L 11/34*** | (2006.01) |

(52) U.S. Cl.
CPC ..... *A47L 11/1625* (2013.01); *A47L 11/201* (2013.01); *A47L 11/293* (2013.01); *A47L 11/34* (2013.01); *A47L 11/4002* (2013.01); *A47L 11/4016* (2013.01); *A47L 11/4072* (2013.01); *A47L 11/4075* (2013.01); *B08B 3/10* (2013.01); *Y10T 137/8376* (2015.04)

(58) Field of Classification Search
CPC .. A47L 11/161; A47L 11/1625; A47L 11/201; A47L 11/293; A47L 11/34; A47L 11/4016; Y10T 137/8376
USPC ..... 134/58 R; 137/560
See application file for complete search history.

(56) References Cited

U.S. PATENT DOCUMENTS

| | | | |
|---|---|---|---|
| 2,000,930 | A | 5/1935 | De Nagy |
| 2,063,253 | A | 12/1936 | Kuhnel et al. |
| 2,624,063 | A | 1/1953 | Van Der Heem |
| 2,744,272 | A | 5/1956 | Theis et al. |
| 2,764,394 | A | 9/1956 | Miller |
| 2,904,817 | A | 9/1959 | Brennan et al. |
| 3,243,832 | A | 4/1966 | Allen et al. |
| 3,619,848 | A | 11/1971 | Salzmann |
| 3,840,935 | A | 10/1974 | Fitzgerald, Jr. et al. |
| 3,849,823 | A | 11/1974 | Adamson et al. |
| 3,864,784 | A | 2/1975 | Kilstrom et al. |
| 3,940,826 | A | 3/1976 | Phillips et al. |
| 4,037,290 | A | 7/1977 | Rose et al. |
| 4,182,001 | A | 1/1980 | Krause |
| 4,377,018 | A | 3/1983 | Cain |
| 4,441,229 | A | 4/1984 | Monson |
| 4,464,810 | A | 8/1984 | Karpanty |
| 4,542,556 | A | 9/1985 | Hepple |
| 4,544,702 | A | 10/1985 | DeVera |
| 4,571,849 | A | 2/1986 | Gardner et al. |
| 4,692,959 | A | 9/1987 | Monson |
| 4,731,956 | A | 3/1988 | Wood |
| D295,092 | S | 4/1988 | Mizuno et al. |
| 4,862,551 | A | 9/1989 | Martinez et al. |
| D306,788 | S | 3/1990 | McAllister et al. |
| 4,989,294 | A | 2/1991 | Fischer |
| 5,048,148 | A | 9/1991 | Gleadall |
| 5,237,719 | A | 8/1993 | Dwyer, Jr. et al. |
| D345,234 | S | 3/1994 | Iorli |
| 5,312,044 | A | 5/1994 | Eaton |
| 5,392,492 | A | 2/1995 | Fassauer |
| D381,144 | S | 7/1997 | Moine et al. |
| 5,706,549 | A | 1/1998 | Legatt et al. |
| 5,778,646 | A | 7/1998 | Pfisterer |
| 5,867,864 | A | 2/1999 | Miller et al. |
| 5,970,574 | A | 10/1999 | Thrash, Jr. |
| 6,013,227 | A | 1/2000 | Lin et al. |
| 6,052,861 | A | 4/2000 | Keller |
| D424,766 | S | 5/2000 | Martin |
| 6,151,748 | A | 11/2000 | Earhart, Jr. et al. |
| 6,151,784 | A | 11/2000 | Maruyama |
| 6,243,914 | B1 | 6/2001 | Studebaker |
| 6,370,728 | B1 | 4/2002 | Burns |
| 6,413,323 | B2 | 7/2002 | Shook et al. |
| 6,421,875 | B1 | 7/2002 | Coombs et al. |
| D468,499 | S | 1/2003 | Kitts |
| D479,636 | S | 9/2003 | Kitts |
| D518,259 | S | 3/2006 | Wertz |
| D520,202 | S | 5/2006 | Dyson et al. |
| D522,197 | S | 5/2006 | Dyson et al. |
| 7,159,271 | B2 | 1/2007 | Sepke et al. |
| D538,986 | S | 3/2007 | Ingram |
| D565,262 | S | 3/2008 | Dyson et al. |
| 7,392,566 | B2 | 7/2008 | Gordon et al. |
| 7,624,474 | B1 | 12/2009 | Cho |
| D635,315 | S | 3/2011 | Wertz |
| 7,962,995 | B2 | 6/2011 | Allaway |
| D643,169 | S | 8/2011 | Calvert |
| D663,909 | S | 7/2012 | Andreesen |
| 8,453,293 | B1 | 6/2013 | Monson |
| 8,510,902 | B2 | 8/2013 | Kappos |
| 9,066,647 | B2 | 6/2015 | Kappos |
| 2002/0178529 | A1 | 12/2002 | Geyer et al. |
| 2005/0144751 | A1 | 7/2005 | Kegg et al. |
| 2005/0283936 | A1 | 12/2005 | Barker et al. |
| 2006/0196074 | A1 | 9/2006 | Vilhunen |
| 2007/0079472 | A1 | 4/2007 | Carter et al. |
| 2007/0113368 | A1 | 5/2007 | Alexander |
| 2007/0226943 | A1 | 10/2007 | Lenkiewicz et al. |
| 2008/0094784 | A1 | 4/2008 | Adunka et al. |
| 2008/0163562 | A1 | 7/2008 | Conant |
| 2009/0038105 | A1 | 2/2009 | Mayer |
| 2009/0139046 | A1 | 6/2009 | Kappos |
| 2010/0024244 | A1 | 2/2010 | Potter |
| 2010/0212688 | A1 | 8/2010 | Goff |
| 2012/0151708 | A1 | 6/2012 | Carter et al. |
| 2012/0233804 | A1 | 9/2012 | Studebaker et al. |
| 2014/0115816 | A1 | 5/2014 | Bruders et al. |
| 2014/0137895 | A1 | 5/2014 | Bruders et al. |
| 2015/0374192 | A1 | 12/2015 | Kappos |
| 2016/0160506 | A1 | 6/2016 | Studebaker et al. |

OTHER PUBLICATIONS

"TMF Review: Flash Xtractor by Waterclaw," http://www.youtube.com/watch?v=ts0xmTmBFsY, uploaded Jul. 2, 2010, 1 page.

Internet Publication "Positive vs. Negative Angles," http://www4.nau.edu/ifwd/ts_lessons/angle/angle_upload/A_posneg.htm, 1 page, 2003.

UltimateWasher.com "UltimateWasher," retrieved Feb. 24, 2013, 7 pages.

114
115
114
100
116
117
106a
PRESSURIZED FLUID SOURCE
102
111
105
106b
103
VACUUM SOURCE
109
108
123
122
110
110

120
128a
126
112
118
125
104
117
119
130

110
145
123
128a
128b
118
117
104
129
$G_1$ 110
126
$V_2(V_2>V_1)$
125
4A
4A 110
126
$(V_3>V_2>V_1)$
125

123
$V_2(V_2>V_1)$
118
235
229a
243
456a
456b
242
232
123
126
454
AIR
125
229a
130
FLOOR
242

POWER/WATER SUPPLY AND RECLAMATION TANK FOR CLEANING DEVICES, AND ASSOCIATED SYSTEMS AND METHODS

CROSS-REFERENCE TO RELATED APPLICATION

The present application claims priority to U.S. Provisional Application No. 61/905,050, filed Nov. 15, 2013, which is incorporated herein by reference.

TECHNICAL FIELD

The present disclosure is directed generally to portable power and water supplies for hard surface and/or carpet cleaners, including a portable platform with a fresh/waste water tank and two or more electrical power connectors that can be coupled to separate power sources.

BACKGROUND

Conventional devices have been developed to supply fresh water to surface cleaners. One drawback associated with such devices is that they cannot be effectively operated in places with limited space. Another drawback is that such devices do not offer a suitable solution for handling waste water. Still another drawback with such devices is the electrical power cords used to provide power to the surface cleaners can hinder the maneuverability of the surface cleaners. As a result, there exists a need for an improved portable power and water supply suitable for cleaning tools, including hard surface (e.g., tiled and/or grouted surface) cleaners and carpet cleaners.

DETAILED DESCRIPTION

The present disclosure is directed generally to apparatuses, systems and methods for supplying electrical power and fresh water to surface cleaning tools (e.g., cleaners for carpets and cleaners for hard surfaces, including concrete, decking, tiles and/or grout). The apparatuses, systems, and devices can also retrieve waste water from the cleaning tools. Specific details of several embodiments of the disclosed technology are described below with reference to particular configurations. In other embodiments, aspects of the disclosed technology can include other arrangements. Several details describing structures or processes that are well-known and often associated with these types of systems but that may unnecessarily obscure some significant aspects of the presently disclosed technology are not set forth in the following description for purposes of clarity. Although the following disclosure sets forth several embodiments of different aspects of the disclosed technology, several other embodiments can have different configurations and/or different components than those described in this section. Accordingly, the disclosed technology may include other embodiments with additional elements not described below with reference to FIGS. 1-9B, and/or without several of the elements described below with references to FIGS. 1-9B.

Representative surface cleaners are described below with reference to FIGS. 1A-6B. Representative portable water and power supply devices, which interface with the surface cleaners, are described below with reference to FIGS. 7A-9B.

Representative Surface Cleaners

Figures 1A, 1B:
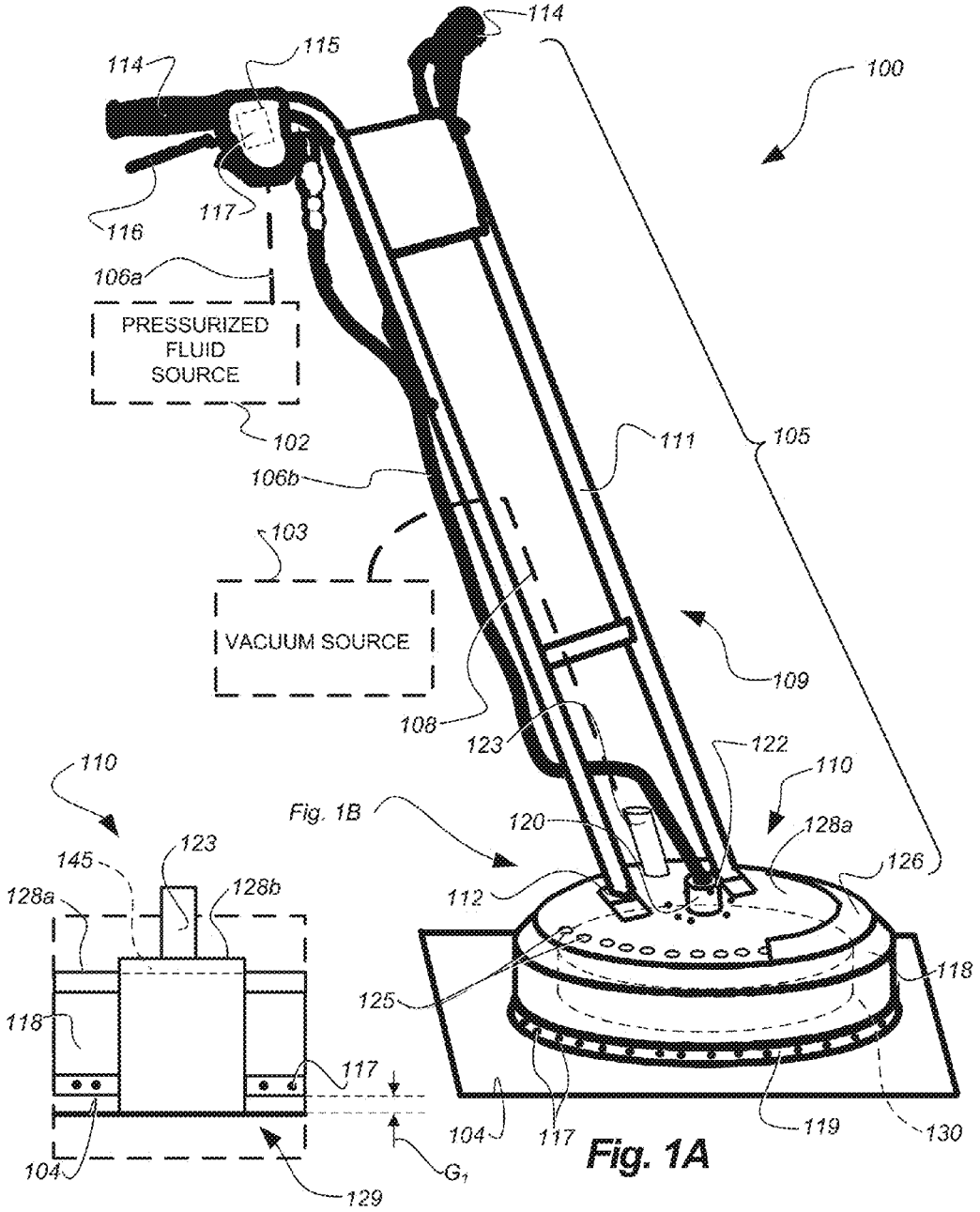
FIGS. 1A and 1B are an isometric illustration (FIG. 1A) and a rearview illustration (FIG. 1B) of a high pressure system including a surface cleaner with a cleaning head configured in accordance with an embodiment of the present technology.

FIGS. 1A and 1B are an isometric view (FIG. 1A) and a rear view (FIG. 1B) of a hard-surface cleaning system 100 suitable for cleaning hard surfaces, including, for example, concrete, decking, tiles and/or grout. Referring first to FIG. 1A, the system 100 includes a pressurized fluid source 102 (shown schematically), a vacuum source 103 (also shown schematically), and a surface cleaner 105. In the illustrated embodiment, the fluid source 102 is coupled to a first fluid supply line 106*a* (e.g., a hose) and the vacuum source 103 is coupled to a vacuum supply line 108 (e.g., a flexible pipe). In some embodiments, the fluid and vacuum sources 102, 103 are remote sources, including remotely-located (e.g., portable, truck-mounted, etc.), pump-based sources.

The surface cleaner 105 includes a transport assembly 109 operably coupled to a cleaning head 110. The transport assembly 109 includes a columnar frame 111 and hinges 112 pivotally coupling the cleaning head 110 to the columnar frame 111. The columnar frame 111 further includes handle grips 114 and a fluid-flow controller 115 positioned proximal to one of the individual handle grips 114. The fluid-flow controller 115 includes a valve 117 (e.g., an "on/off" valve;

shown schematically) and a lever 116. The valve 117 has an input coupled to the first fluid supply line 106*a* and an output coupled to a second fluid supply line 106*b* between the fluid-flow control 115 and the cleaning head 110.

The cleaning head 110 includes a housing 118, a rim 119 at a base of the housing 118, and a rotary union 120 operably coupled to a rotatable spray assembly 130 (e.g., a rotor assembly; shown schematically) within the housing 118. The cleaning head 110 further includes a fluid-supply inlet 122 coupled to the second fluid supply line 106*b*, a vacuum inlet 123 coupled to the vacuum supply line 108, and a number of flow-control inlets 125 (e.g., openings) that are open to the ambient air and adjustably covered by a louver 126. The louver 126 can be attached to a first top wall 128*a* of the housing 110 with tabs, grooves, or other suitable features (not shown) that allow the louver 126 to slide across the flow-control inlets 125 to adjustably cover/uncover the inlets 125.

In operation, an operator uses the transport assembly 109 to hold the cleaning head 110 so that it is generally parallel with a floor surface 104, while moving the cleaning head 110 across the floor surface 104. The hinges 112 allow the operator to change the angle of the columnar frame 111 (relative to the floor surface 104) but still maintain a parallel alignment. For example, the operator can change the angle of the columnar frame 111 to raise or lower the handle grips 114 (e.g., to accommodate the operator's height). As the operator moves the cleaning head 110 across the floor surface 104, the rim 119 reduces friction between the housing 118 and the floor surface 104. In one embodiment, the rim 119 can include a nonabrasive material such as polyethylene, which can pass over smooth surfaces without causing damage. In another embodiment, the rim 119 can include a "brush cup," such as a ring of bristles or coarse materials suitable for non-smooth surfaces, including asphalt, unfinished concrete, etc.

The operator can operate the lever 116 to open the valve 117 to deliver the pressurized fluid to the spray assembly 130 via the second fluid supply line 106*b*. In some embodiments, the pressurized fluid can include water and/or chemicals, such as those containing suitable acidic and/or alkaline elements. In one embodiment, suitable chemicals are available from Sapphire Scientific of Prescott, Ariz.

After receiving the pressurized fluid, the spray assembly 130 sprays the pressurized fluid toward a portion of the floor surface 104 at least partially enclosed by the housing 118. The fluid spray imparts a mechanical cleaning action for dislodging debris and contaminants from the floor surface 104. The spray assembly 130 also rotates to distribute the spray across the portion of the floor surface. As described in greater detail below, the user can adjust the rotational velocity of the spray by adjusting the louver 126 (i.e., by covering/uncovering a portion of the flow-control inlets 125 with the louver 126). In one embodiment, the pressurized fluid has an operating pressure in the range of about 700-2500 psi. In another embodiment, the rotational speed is in the range of about 1500-3000 rpm.

While the spray is delivered to the floor surface 104, the vacuum inlet 123 collects spent fluid (e.g., non-pressurized fluid containing debris and contaminants) which is then drawn by the vacuum source 103. The rim 119 can form a seal that at least partially contains the spent fluid within an enclosure defined by the housing 118. In some embodiments, the rim 119 can include apertures 117 that allow air to enter the cleaning head 110 as the vacuum is drawn on the cleaning head 110. Accordingly, the apertures 117 can prevent the cleaning head 110 from clamping down (e.g., "sucking down") onto the hard surface under the force of the vacuum.

As best seen in FIG. 1B, the housing 118 can include a "bump-out" region 129 toward a rear portion of the cleaning head 110 that slightly raises the rear portion of the head above the floor surface 104 by a gap $G_1$. Similar to the apertures 117, the bump-out region 129 allows ambient air to enter the cleaning head 110 to prevent the cleaning head 110 from clamping down. The bump-out region 129 also defines a vacuum cavity 145 (drawn in broken lines) within an enclosure of the cleaning head 110 and between the first top wall 128*a* and a second top wall 128*b* of the housing 118. The vacuum cavity 145 is connected to the vacuum inlet 123 to draw a vacuum on the interior region of the cleaning head 110.

Figure 2B:
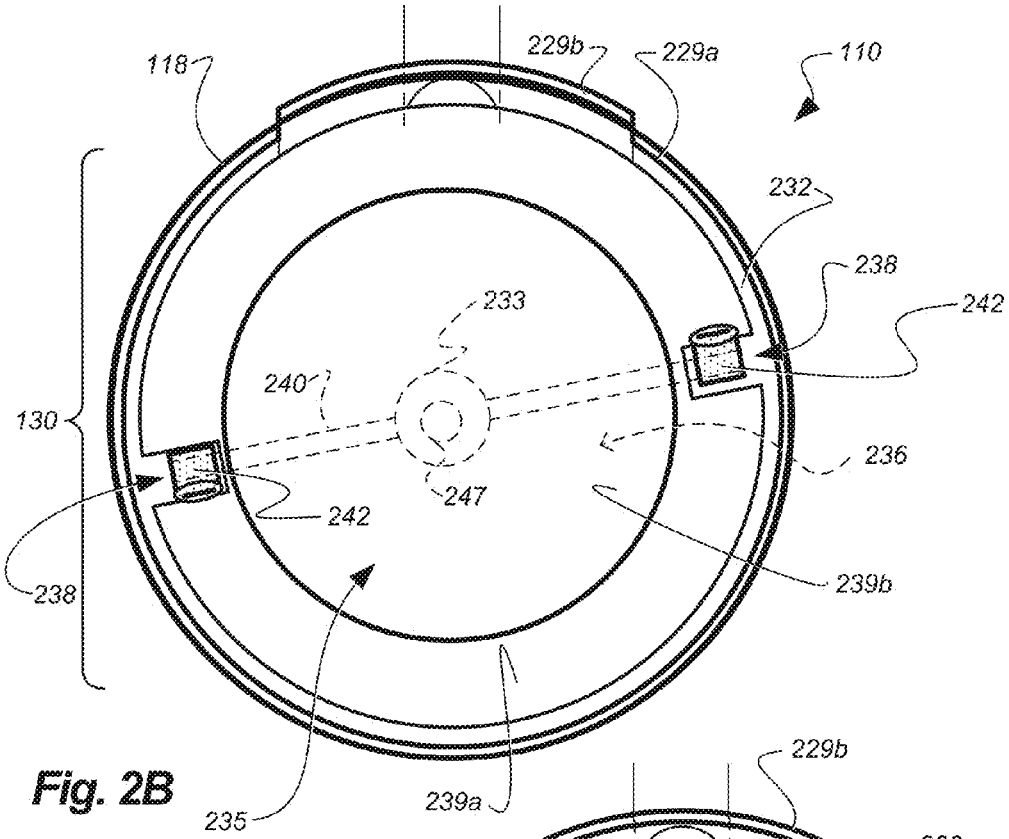
FIGS. 2A and 2B are top view illustrations of the cleaning head of FIG. 1 configured in accordance with an embodiment of the present technology.
Figure 2A:
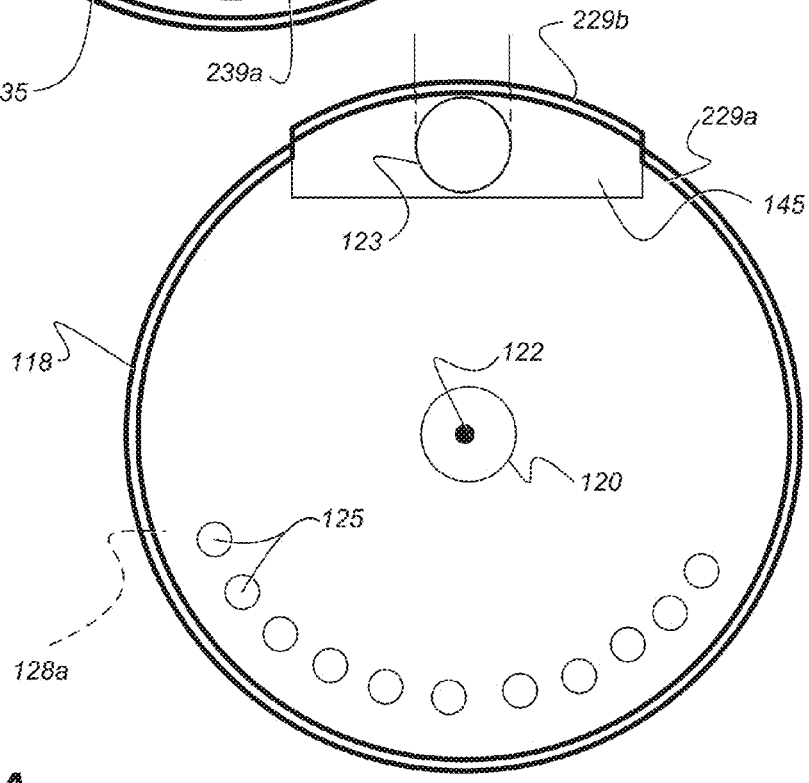

FIGS. 2A and 2B are bottom view illustrations of the cleaning head 110 showing the housing 118 without the spray assembly 130 installed (FIG. 2A) and the housing 118 with the spray assembly 130 installed (FIG. 2B). For purposes of illustration, FIGS. 2A and 2B show the cleaning head 110 without the rim 119. Referring first to the bottom view of FIG. 2A, the housing 118 includes a first sidewall 229*a* at least partially surrounding a circumference of the housing 118 and a second sidewall 229*b* at least partially defining a portion of the vacuum cavity 145. The vacuum cavity 145 at least partially surrounds the vacuum inlet 123. The flow-control inlets 125 extend through the first top wall 128*a* and open the interior of the housing 118 to ambient air.

Referring to the bottom view of FIG. 2B, the spray assembly 130 includes a round plate 232 and a shaft 233 (drawn in broken lines) operably coupled between the plate 232 and the rotary union 120 (FIG. 1). The plate 232 is spaced apart from the first sidewall 229*a* by a gap and includes a first lower side 235, a second upper side 236, and slots 238 extending through the plate 232 at its periphery. At the first lower side 235, the plate 232 includes an outer surface 239*a* and an inner surface 239*b* that is raised upwardly out of the plane of the page. At the second upper side 236, the plate 232 includes a spray bar 240 (drawn in broken lines) coupled in fluid communication with two nozzles 242 toward the periphery of the plate 232. The spray bar 240 is attached to the plate 232 and is in fluid communication with the fluid-supply inlet 122 (FIG. 1) via a passageway 247 (drawn in broken lines) through the shaft 233 and the rotary union 120 (FIG. 1). The individual nozzles 242 are connected to opposite ends of the spray bar 240 and extend through one of the slots 238 toward the floor surface 104.

Figure 2C:
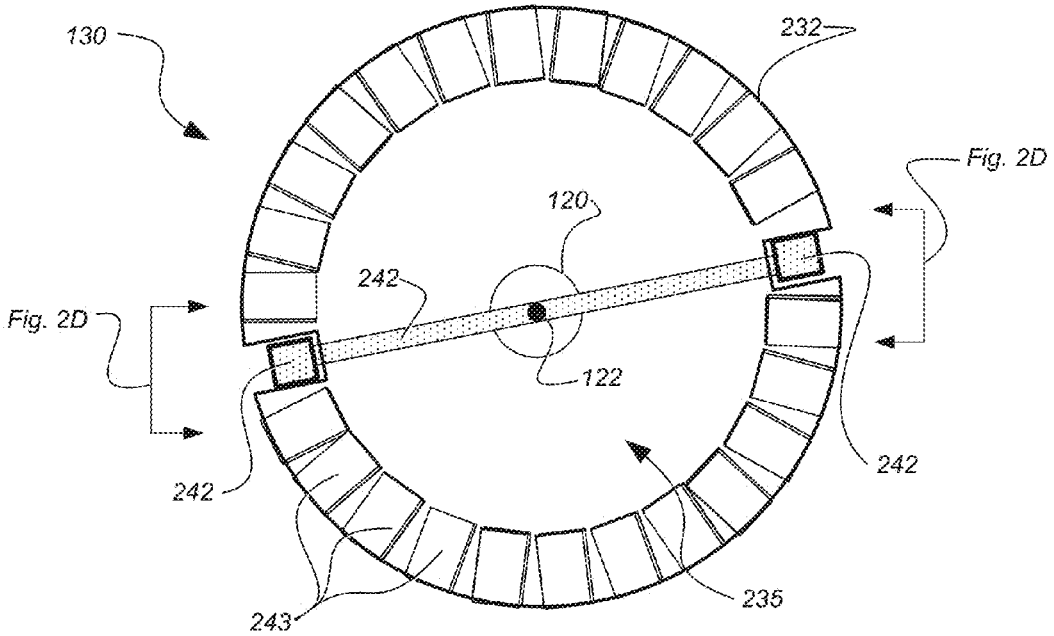
FIGS. 2C and 2D are a top view illustration (FIG. 2C) and an enlarged side view illustration (FIG. 2D) of a rotating spray assembly of the cleaning head of FIG. 1 configured in accordance with an embodiment of the present technology.
Figure 2D:
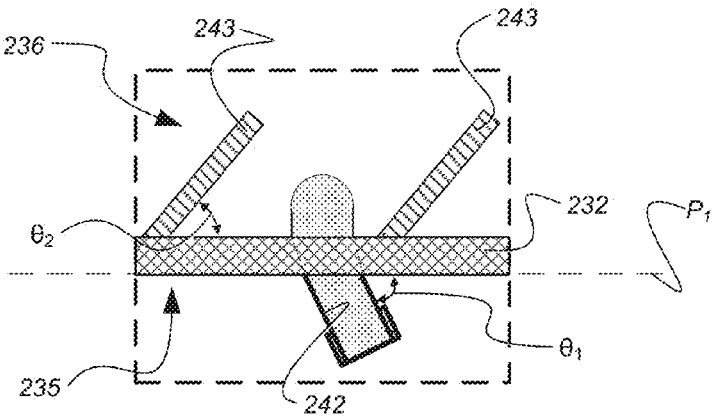

FIG. 2C is a top view illustration of the spray assembly 130 and FIG. 2D is an enlarged side view of a portion at a periphery of the spray assembly 130. Referring to FIGS. 2C and 2D together, the individual nozzles 242 project though the slots at a first angle $\theta_1$ relative to the plane $P_1$ of the plate 232. Because the nozzles 242 are inclined, the spray from the nozzles 242 imparts a rotational velocity to the spray assembly 130. In one embodiment, the first angle $\theta_1$ is in the range of about 70 to 75 degrees. In other embodiments, however, the first angle $\theta_1$ can be larger or smaller. For example, it is expected that a larger first angle $\theta_1$ will achieve more downward fluid-force, and a smaller rotational velocity. Similarly, it is also expected that a smaller first angle $\theta_1$ may achieve less downward fluid-force, and a larger angular velocity. Accordingly, the nozzles 242 can be oriented differently, including angled differently to achieve certain rotational velocities and/or downward fluid force. In addition, in some embodiments, the plate 232 can be configured with different arrangements of nozzles and sprays bars, including additional nozzles and spray bars.

With reference again to FIGS. 2C and 2D, the individual fins 243 project above the plane of $P_1$ of the plate 232 at a second angle $\theta_2$. The second angle $\theta_2$ is configured to appropriately position the fins 243 across a stream of rapidly moving air between the flow-control inlets 125 shown in FIG. 1A and the vacuum cavity 245 also shown in FIG. 1A. As described in greater detail below, it is believed that the rapidly moving air creates lift that can assist the rotation of the spray assembly 130. In one embodiment, the second angle $\theta_2$ is in the range of about 60 to 90 degrees. It is expected, however, that the second angle $\theta_2$ can be outside this range in some embodiments to create a particular amount of lift. Further, the plate 232 can be configured to include more or fewer fins, variously sized fins (e.g., lengths, widths, and thicknesses), differently shaped fins, etc. to achieve an expected amount with suitable lift.

Figures 3A, 3B:
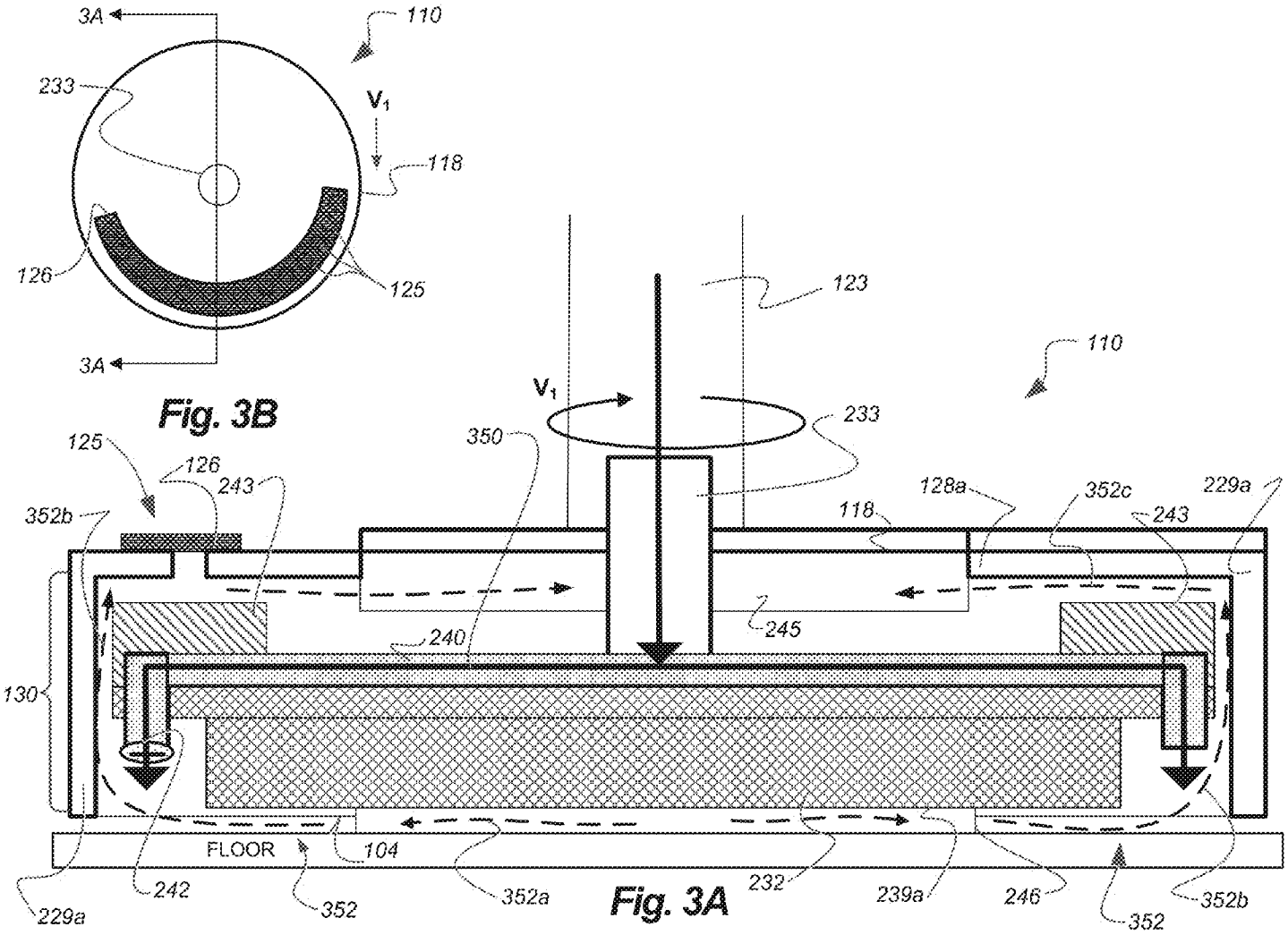
FIGS. 3A and 3B are a side view illustration (FIG. 3A) and a top view illustration (FIG. 3B) of the cleaning head of FIG. 1 in a first operational state in accordance with an embodiment of the present technology.

FIGS. 3A and 3B are, respectively, cross-sectional and top view illustrations of the cleaning head 110 in a first state of operation in which the spray assembly 130 has a first rotational speed $V_1$ about the shaft 233. Referring to FIGS. 3A and 3B together, the louver 126 is movably positioned to completely cover the flow-control inlets 125 to prevent ambient air from entering through the flow-control inlets 125. As discussed above, ambient air can nevertheless enter through apertures 117 in the rim 119 (FIG. 1) and/or through a gap defined by the bump-out region 246 (i.e., to prevent clamp down).

In the first state of operation, the spray nozzles 242 direct a pressurized fluid 350 toward the floor surface 104, which causes the spray assembly 130 to rotate at the first rotational velocity $V_1$. As the cleaning head 110 is moved across the floor surface 104, the spent fluid moves underneath the plate 232. In general, it is believed that the cleaning head 110 removes the spent fluid by a multi-step process that involves a "sling action" in combination with suction at the vacuum cavity 245. In particular, it is believed that the sling action causes the spent fluid to move along a fluid flow path 352 (shown as a combination of first through third fluid flow path segments 352*a*-352*c*) that is bounded by portions of the inner surface 239*a* of the plate 232, an inner surface of the first sidewall 229*a*, and an inner surface of the first top wall 128*a*. Once the spent fluid reaches the vacuum cavity 245, the vacuum inlet 123 removes the spent fluid from the enclosure of the housing 118.

Without being bound by a particular theory, it is believed that rotating the plate 232 in combination with surface tension at the inner surface 239*a* of the plate 232 imparts momentum to the spent fluid. The imparted momentum is believed to cause the spent fluid to move underneath the plate 232 along the first fluid flow path segment 352*a* and toward the first sidewall 229*a*. Accordingly, it is believed that the inner surface 239*a* when proximate to the floor surface 104 can promote surface tension, which in turn may promote the sling action.

It is also believed that the imparted momentum in combination with surface tension at the first sidewall 229*a* causes the spent fluid to move upwardly along the second fluid flow path segment 352*b* toward the first top wall 128*a*. It is further believed that when the spent fluid reaches the inner surface of the first top wall 128*a*, imparted momentum and surface tension move the spent fluid inwardly along the third fluid flow path segment 352*c* across the top wall. The fluid then moves across the top wall until it is drawn into the vacuum cavity 245.

Figures 4A, 4B, 4C:
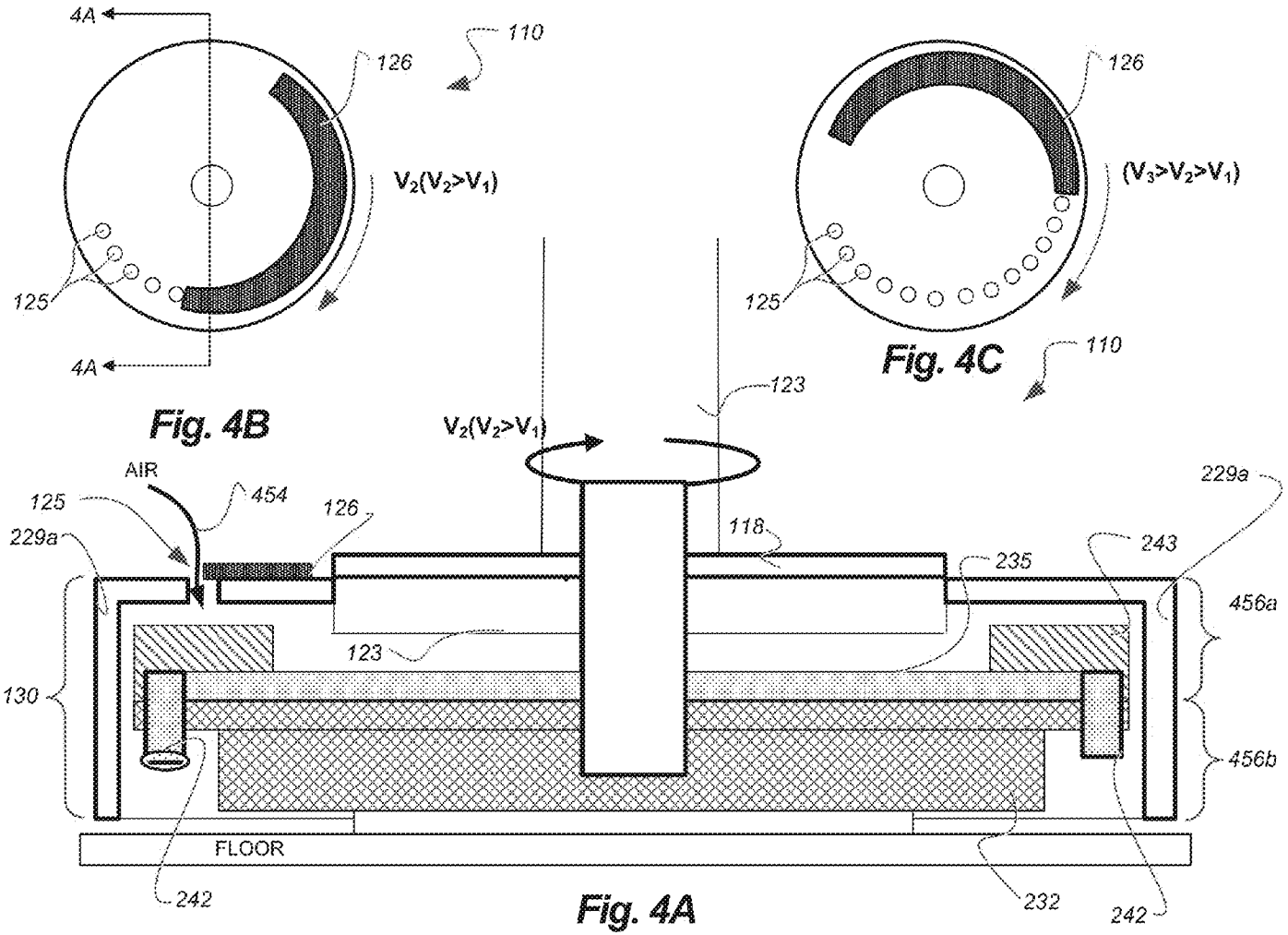
FIGS. 4A and 4B are a side view illustration (FIG. 4A) and a top view illustration (FIG. 4B) of the cleaning head of FIG. 1 in a second operational state in accordance with an embodiment of the present technology.
FIG. 4C a top view illustration of the cleaning head of FIG. 1 in a third operational state in accordance with an embodiment of the present technology.

FIGS. 4A and 4B are, respectively, cross-sectional and top view illustrations of the cleaning head 110 in a second state of operation in which the spray assembly 130 has a second rotational speed $V_2$ greater than the first rotational speed $V_1$. Referring to FIGS. 4A and 4B together, the louver 126 is configured to cover only some of the flow-control inlets 125. When the louver 126 is opened, the vacuum inlet 123 draws ambient air (shown as airflow 454) into the housing 118 through the flow-control inlets 125 and across the second side 235 of the plate 232. It is believed that the rapidly moving airflow 454 across the fins 243 creates lift. It is also believed that this lift in turn increases the rotational speed of the spray assembly 130 (i.e., relative to the first rotational speed $V_1$).

In some embodiments, the plate 232 can separate an upper region 456*a* within the enclosure of the housing 118 from a lower region 456*b*. In the upper region 456*a*, the rotating fins 243 create turbulent airflow. In the lower region 456*b*, the plate 232 is configured to prevent or at least restrict air from mixing with spent fluid (i.e., due to the small gap between the plate 232 and the first sidewall 229*a*).

FIG. 4C is top view illustration of the cleaning head 110 in a third state of operation in which the spray assembly 130 has a third rotational speed $V_3$ greater than the first and second rotational speeds $V_1$, $V_2$. The louver 126 is positioned to fully open all the flow-control inlets 125 to the ambient air. Relative to FIGS. 4A-4B, the completely uncovered inlets 125 allow a larger amount of airflow to enter the cleaning head 110. The larger amount of airflow is believed to create additional lift which further increases the rotational speed of the spray assembly 130.

One feature of several embodiments of the technology disclosed herein is that the louver 126 can be operated to control the rotational speed of the spray assembly. For example, an operator can adjust the louver 126 (e.g., by opening or closing the louver 126) to achieve a rotational speed that yields a suitable cleaning efficacy. An advantage of this feature is that the operator can make a small or large refinement if the fluid-supply pressure drops, the chemistry become diluted, and/or a rough or heavily soiled surface is encountered. This can save time the operator time that might ordinarily be required to adjust fluid pressure, change chemistry, etc.

Another feature of several embodiments of the technology disclosed herein is that the cleaning head 110 can be operated at lower pressures. For example, in some instances delicate surfaces, such as wood decking, can require lower fluid pressures than are used for more robust surfaces. However, lowering the pressure also lowers the rotational speed. Typically, lower rotational speeds are less effective at cleaning and have a higher rate of smearing. In conventional systems, larger rotational speeds at lower pressures would require a motor to provide assistance to the rotation. Thus, an advantage of the cleaning head 110 is that the operator can operate at certain rotational speeds independent of the fluid pressure. For example, if a surface can only be cleaned with a low pressure fluid, the operator can open the louver 126 to provide suitable rotation speed for appropriate cleaning efficacy.

A further advantage of at least some of the foregoing embodiments is that the spray assembly 130 can mitigate the effect of turbulent airflow within the enclosure of the cleaning head 110. For example, the plate 232 can separate airflow through the flow-control inlets 125 to the vacuum inlet 103 the upper and lower regions 456*a*, 456*b* of the spray assembly from each other and thus isolate the effects of turbulence (which may result from airflow through the flow-control inlets 125 to the vacuum inlet 103 from the cleaning action at the floor surface 104.

Figure 5B:
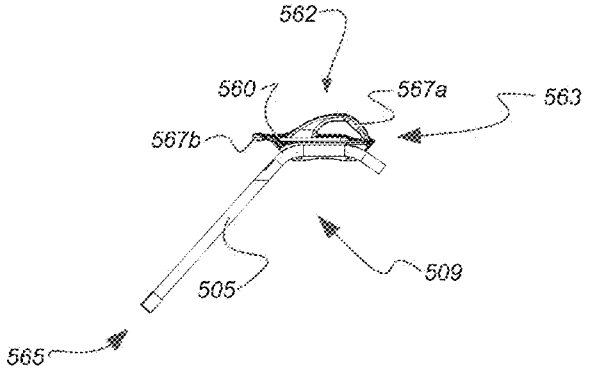
FIGS. 5A-5B are isometric illustrations of another surface cleaner configured in accordance with an embodiment of the present technology.
Figure 5A:
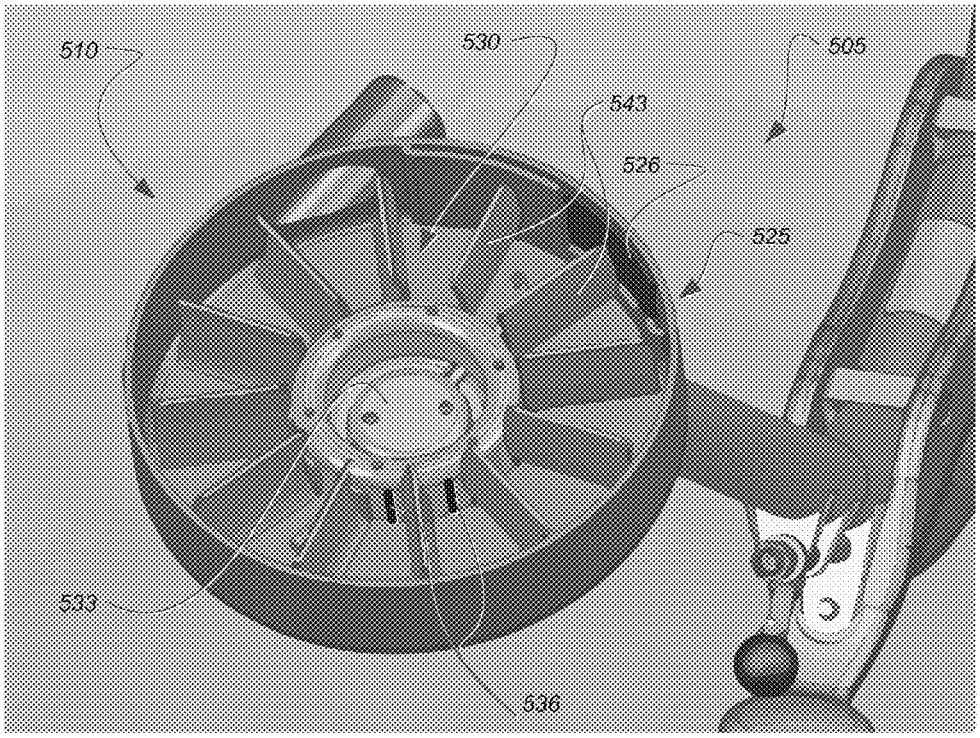

FIGS. 5A-5B are isometric illustrations of a surface cleaner 505 configured in accordance with another embodiment of the present technology. Referring to 5A, the surface cleaner 505 can include a cleaning head 510 that operates in much the same way as the cleaning head 110. However, the cleaning head 510 includes a side-mounted louver 526 and a single fluid control inlet 525. Also, the cleaning head 510 includes a rotatable spray assembly 530 having a shaft 533 carrying a hub with slots 536. The slots 536 can support removable fins 543. In this embodiment, the removable fins 543 can be exchanged with different fins (e.g., fins that are differently sized, shaped, angled, etc.). Also, the slots 536 allow for a varying number of fins. Accordingly, in this embodiment, the fins 543 can be adapted to achieve an expected lift and/or rotational speed.

Referring to 5B, the surface cleaner 505 can include a transport assembly 509 having a different configuration than the transport assembly 109 (FIG. 1). For example, the transport assembly 509 can have a "wand" configuration that includes a tubular member 560 with a handle 562 operably coupled to a first end portion 563 and the cleaning head 510 (not shown in FIG. 5B) operably coupled to a second end portion 565. In this configuration, an operator can hold the surface cleaner 505 by grasping grip regions of the handle 562. For example, the operator can carry the weight of the surface cleaner using a first grip region 567*a* and orient (e.g., angle) the cleaning head 510 using the second grip region 567*b*.

Figure 6A:
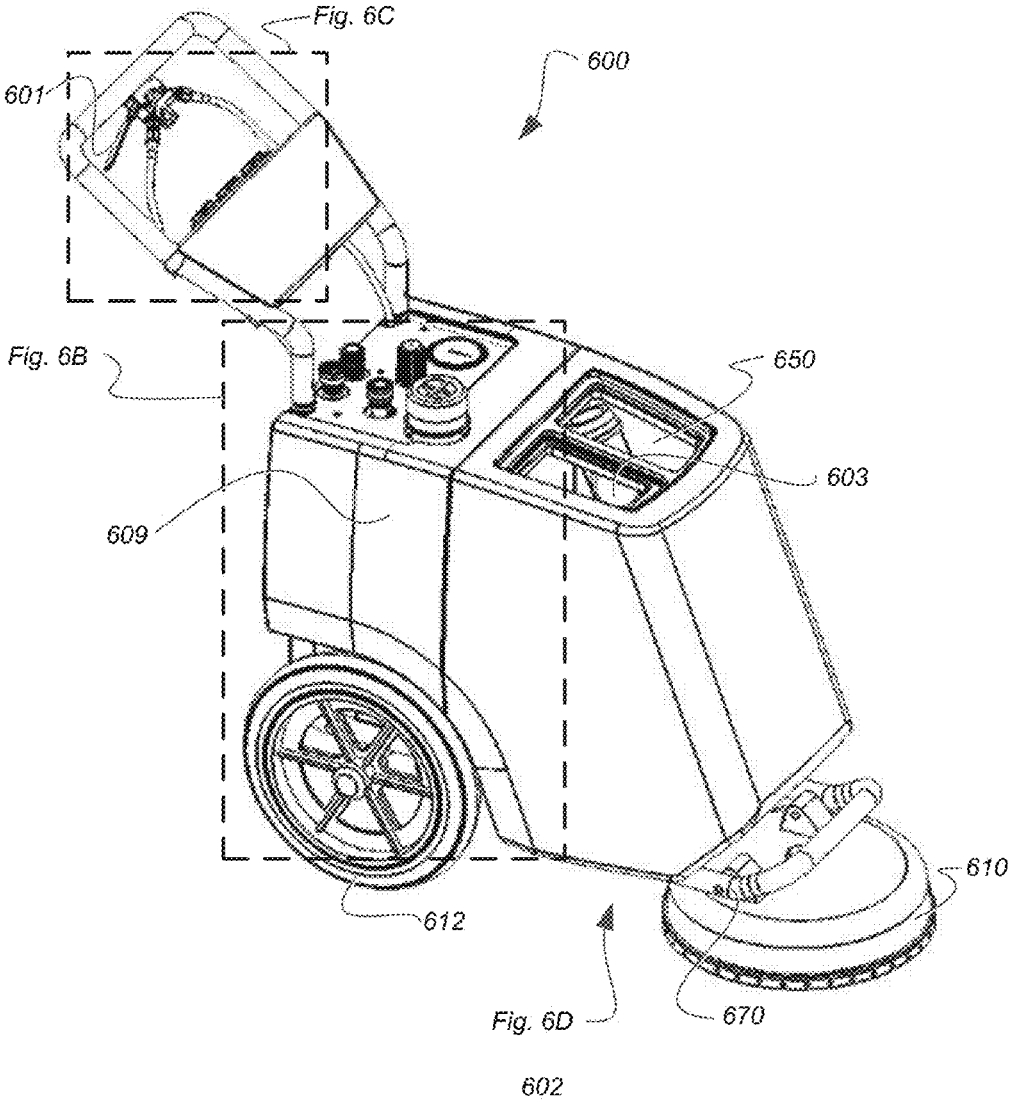
FIGS. 6A-6D are isometric illustrations (FIGS. 6A and 6B), a front view illustration (FIG. 6C), and a bottom view illustration (FIG. 6D) of a self-contained, hard-surface cleaning system configured in accordance with an embodiment of the present technology.

FIGS. 6A-6D are isometric illustrations (FIGS. 6A and 6B), a front view illustration (FIG. 6C), and a bottom view illustration (FIG. 6D) of a self-contained, hard-surface cleaning system 600 configured in accordance with an embodiment of the present technology. Referring first to FIG. 6A, the self-contained cleaning system 600 can include a transport assembly 609 (e.g., a chassis or other support platform) that is movable over a floor surface via one or more wheels 612. The transport assembly 609 can carry a cleaning head 610 that cleans a floor surface over which the system 100 traverses. In one embodiment, the cleaning head 610 is similar in structure and operation to one of the aforementioned cleaning heads 110, 510. In another embodiment, the cleaning head 610 can include different aspects. For example, a level bar 670 can be attached to the transport assembly 609 for positioning the cleaning head 110 generally in parallel with a floor surface.

The transport assembly 609 also carries a water supply fixture 603. The water supply fixture 603 is coupled to a first pump 630*a* shown in FIG. 6B. The water supply fixture 603 can be connected to a water supply hose (not shown in FIG. 6B) via a first fluid inlet 621. For example, the water supply hose can be coupled to an indoor or outdoor water faucet. The water supply fixture 603 directs the incoming fresh water to the first pump 630*a*, which pressurizes the water prior to delivering the water to the cleaning head 610. In a particular embodiment, the first pump 630*a* pressurizes the water to approximately 1200 psi and in other embodiments, the first pump 630*a* pressurizes the water to other suitable pressures. The force of the water exiting the spray nozzles (not visible) can rotate a spray bar (also not visible) at a rate of from about 1500 to about 2000 rpm.

Figure 6B:
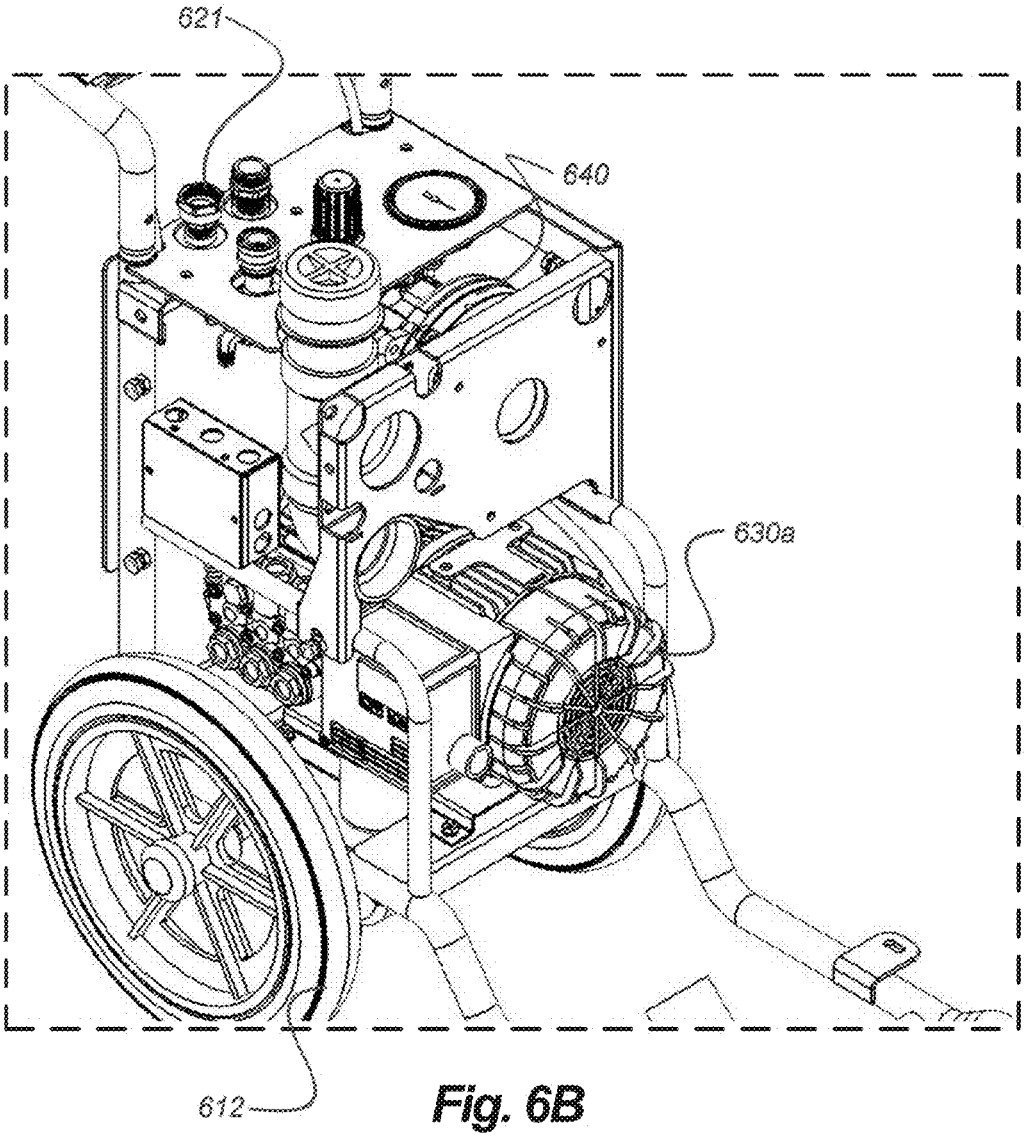
Figure 6C:
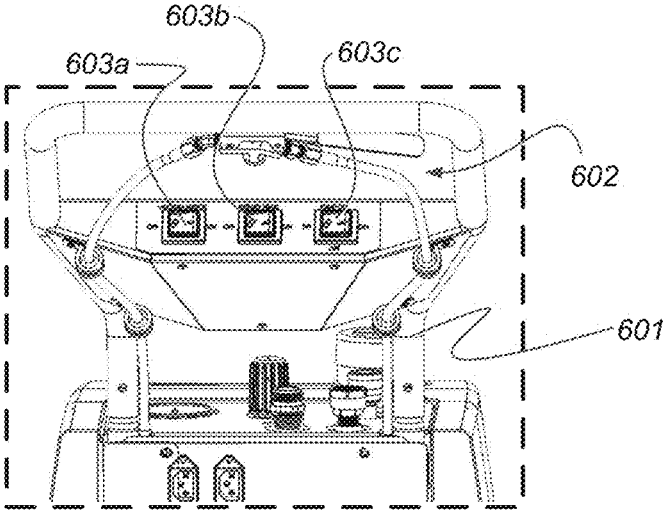
Figure 6D:
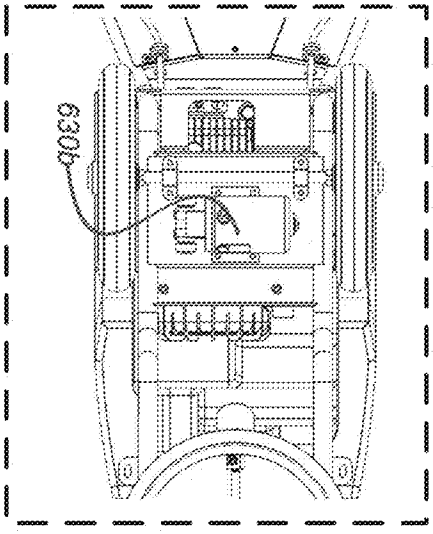

The system 600 can further include a vacuum source 640 (e.g., a vacuum pump) also shown in FIG. 6B carried by the transport assembly 609 and coupled to the cleaning head 610 with a vacuum hose e.g., a relatively short vacuum hose (not shown in FIG. 6B). The vacuum source 640 can be an electrically powered vacuum source, which receives electrical power via a power cable. The vacuum source 640 draws a vacuum on the cleaning head 610 via the vacuum hose, and directs exhaust outwardly via a vacuum exhaust (not shown in FIG. 6B). As wastewater, debris and air are removed by the vacuum source 640 from the cleaning head 610, the water and other debris may be collected in a vessel or tank 650 (FIG. 6A), also carried by the transport assembly 609. As the vessel 650 fills with water and/or debris, the user can periodically or continuously empty the vessel using a pump-out hose (not shown in FIG. 6D) that is coupled to a second pump 630*b* (FIG. 6D). Accordingly, the user can clean the target surface and direct the collected wastewater to a suitable drain or other facility.

Referring again to FIG. 6A, the transport assembly 609 can further include a handle 601 for pushing and/or pulling the transport assembly 609. Now referring to FIG. 6C, the handle 601 can further includes one or more sets of controls 602 for directing the flow of fresh water into the cleaning head 610, directing the operation of the vacuum source 640, and/or directing the process of emptying the vessel 650. In a particular embodiment, the controls 602 include a first switch 603*a*, to initiate water flow, a second switch 603*b* that powers the vacuum source 640, and a third switch 603*c* that powers the second pump 630*b*.

In several embodiments, one advantage of the self-contained system disclosed herein is that multiple components used for cleaning hard surfaces can be carried by a single chassis. For example, a single chassis can carry the cleaning head, the wastewater collection vessel, the vacuum source, a pump for delivering high pressure water, and a pump for emptying the collection vessel. An advantage of this feature is that it can reduce overall system complexity by providing all the necessary components in one compact platform. In other embodiments, one or more of these components may be moved off the chassis while still providing at least some of the advantages described above.

In at least some of the foregoing embodiments, another advantage of the self-contained system is that the water supply hose can be coupled to a conventional faucet, and can be pressurized using an on-board first pump 630*a*. An advantage of this arrangement is that it can eliminate the need for larger truck-mounted or separate portable pressurized water systems. In addition, the self-contained cleaning system 600 can include an on-board vacuum source 640 and provisions for emptying the vessel 650 into a conventional drain (e.g., the second pump 630*b* and a pump-out hose). Advantages of these features include an overall compact arrangement, and a system that can be particularly suitable for the homeowner, occasional user (e.g., renter), and/or a user without access to more complex truck-mount systems.

In at least some of the foregoing embodiments, a further advantage of the self-contained system is that a vacuum hose between the vacuum source 640 and the cleaning head 610 is relatively short because the vacuum source 640 and the cleaning head 610 are within the common transport assembly 609. By eliminating the long hoses typically connecting conventional cleaning heads to truck-mounted or portable collection systems, the overall system efficiency can be improved by reducing frictional losses.

Representative Portable Power and Water Supply Devices

Figure 7A:
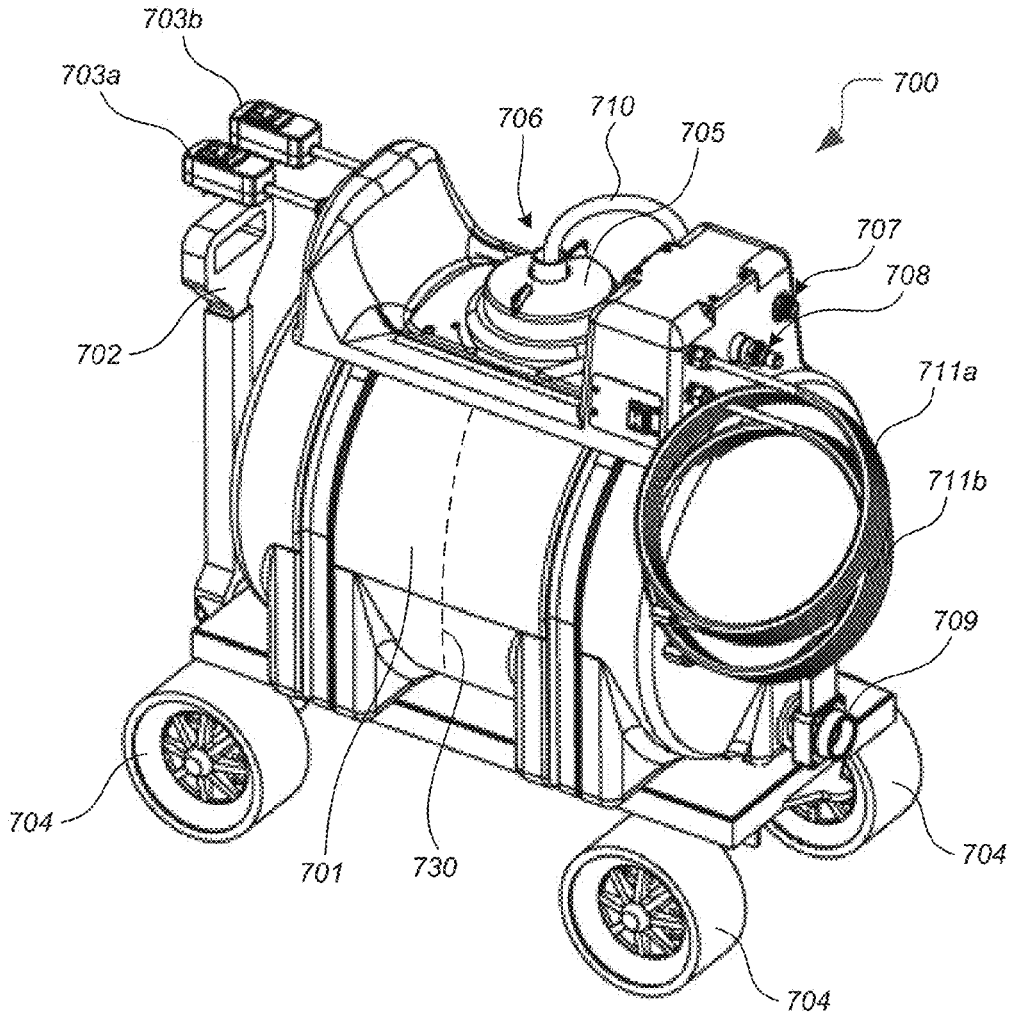
FIG. 7A is an isometric illustration of a portable power and water supply platform configured in accordance with an embodiment of the present technology.

FIG. 7A is an isometric illustration of a portable power and water supply platform 700 configured in accordance with an embodiment of the present technology. The portable power and water supply platform 700 can provide fresh water to a cleaning tool. For example, the platform 700 can provide fresh water to a hard surface cleaner as described above with reference to FIGS. 1A-6D, and/or a carpet cleaner described in U.S. patent application Ser. No. 13/843,618, filed Mar. 15, 2013, which is incorporated herein by reference in its entirety.

As shown in FIG. 7A, the portable power and water supply platform 700 includes a tank (or container) 701, a handle 702, two electrical connectors 703*a* and 703*b*, wheels 704, a tank cap 705, a fresh water inlet 706, a fresh water outlet 707, a waste water inlet 708, a waste water outlet 709, a draw tube 710, and two electrical power lines 711*a* and 711*b*. In the illustrated embodiment, the tank 701 can include an internal bladder 730 (shown schematically) positioned inside the tank 701. The bladder 730 can accordingly form a divider that divides the tank 700 into a first portion for storing fresh water and a second portion for storing waste water. In at least some embodiments, the divider can be flexible. In other embodiments, the divider can be rigid. As the volume occupied by the fresh water decreases, the volume occupied by the waste water increases, and the total volume within the tank 701 can remain constant. In particular embodiments, the tank 701 can carry enough fresh water to allow the attached cleaning tool to operate for 15 minutes, 30 minutes, or other suitable periods of time. In some embodiments, an operator can move or adjust the divider according to an operating status of the cleaning tool that is connected with the platform 700 (e.g., to allocate proper spaces for fresh water and waste water).

Figure 7B:
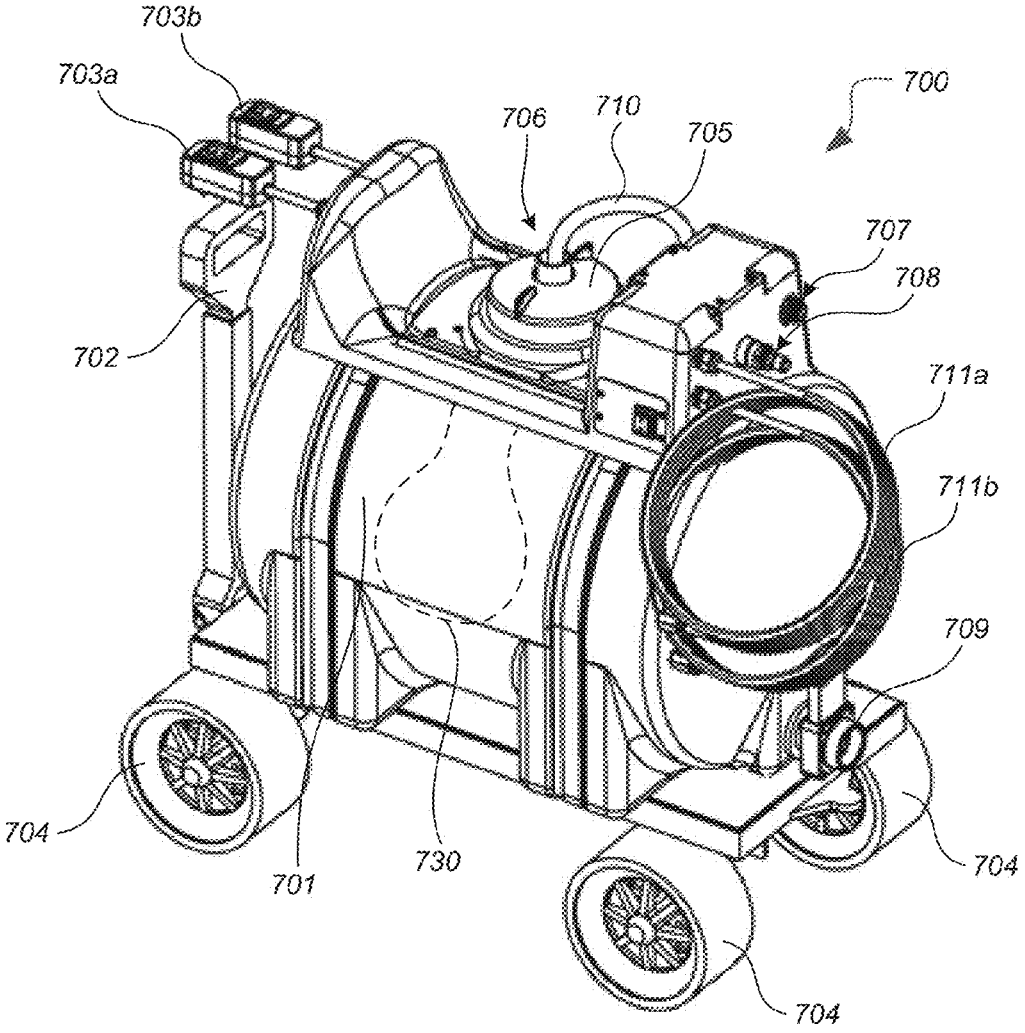
FIG. 7B is an isometric illustration of a portable power and water supply platform configured in accordance with another embodiment of the present technology.

FIG. 7B is an isometric illustration of a portable power and water supply platform configured in accordance with a particular embodiment of the present technology. In FIG. 7B, the bladder 730 can form a flexible internal container within the tank 701. Accordingly, the bladder 730 can store fresh water inside, and the rest of the tank 701 (e.g., the space outside the bladder 730) can be used to store waste water.

As shown in FIG. 7B, the tank cap 705 is positioned on the tank 701 to prevent water spillage. Fresh water can be added to the tank 701 through the fresh water inlet 706, and then stored in the bladder 730 (or the first portion of the tank 701). As shown in FIG. 7B, a user can use the handle 702 to maneuver or control the portable power and water supply platform 700. In other embodiments, the handle 702 can have different designs (e.g., the platform 700 can have two or more handles). The wheels 704 can support the tank 701 and provide portability thereof. In other embodiments, the portable power and water supply platform 700 can have more or fewer than the four wheels 704 shown in FIG. 7B.

In the illustrated embodiment, the electrical connectors 703*a* and 703*b* can be electrically coupled to different power sources e.g., different circuits in a house or other building. This arrangement allows the portable power and water supply platform 700 to provide power to a corresponding cleaning tool via multiple wall electrical power sources (or other types of power sources) that individually provide only a limited amount of electrical current (e.g., 15 amps), which may be insufficient to adequately power the cleaning tool. The electrical connectors 703*a* and 703*b* are electrically coupled to the electrical power lines 711*a* and 711*b* respectively that are in turn coupled to the cleaning tool. In some embodiments, the electrical connectors 703*a* and 703*b* can include corresponding individual safety components (e.g., safety switches, circuit breakers, lighted indicators, and/or similar elements). Further details regarding the connections between the cleaning tool and the portable power and water supply platform 700 are discussed below with reference to FIG. 8.

Figure 8:
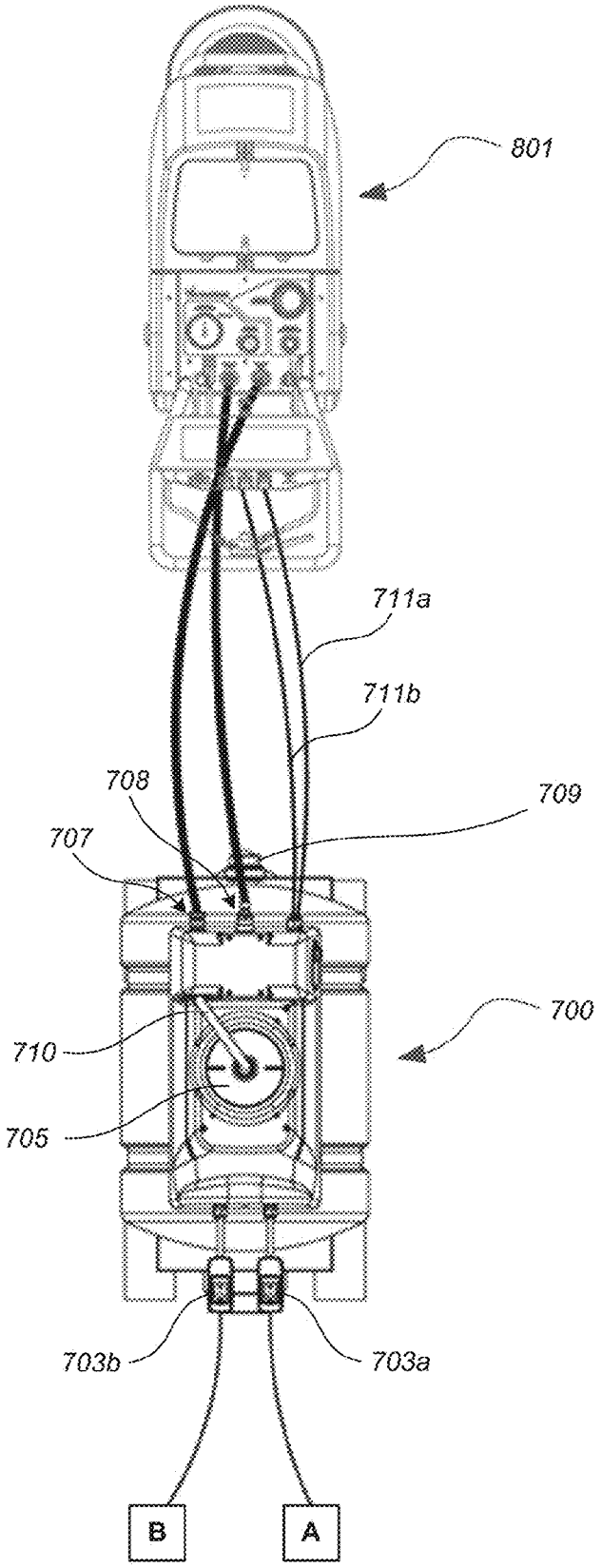
FIG. 8 is a top view illustrating the connections between a cleaning tool and the portable power and water supply platform shown in FIG. 7A.

FIG. 8 is a top view illustrating the connections between a cleaning tool 801 and the portable power and water supply platform 700 described with reference to FIGS. 7A and 7B. Fresh water is transferred to the cleaning tool 801 through the draw tube 710 (described further below with reference to FIGS. 9A and 9B) and the fresh water outlet 707. An on-board pump pressurizes the water for delivery to the cleaning tool 801. Waste water returns to the tank 701 (e.g., the space outside the bladder 730, or the second portion of the tank 701) through the waste water inlet 708. When appropriate, the waste water can be drained out from the tank 701 through the waste water outlet 709.

As shown in FIG. 8, the electrical power lines 711*a* and 711*b* are electrically coupled with and provide electrical power to the cleaning tool 801. In particular embodiments, each of the electrical power lines 711*a* and 711*b* can be coupled to a different circuit (or control unit) of the cleaning tool 801. In some embodiments, the cleaning tool can include multiple circuits designed for different components. For example, the cleaning tool can have a first circuit designed to supply electrical power to a first component, such as a motor for rotating a rotary union inside a cleaning head or a nozzle dispensing cleaning fluids. The cleaning tool can have a second circuit designed to supply power to a second component, such as a motor for draining waste water out from the cleaning tool. In some embodiments, the first circuit can supply a first amount of electrical current to the first component and the second circuit can supply a second amount of electrical current to the second component. In some embodiments, the first amount and the second amount can be generally identical. In some embodiments, the electrical power lines 711*a* and 711*b* can be coupled to the first circuit and the second circuit respectively. In such embodiments, the power can be directly supplied to the first circuit through the electrical power line 711*a* and to the second circuit by the electrical power line 711*b*. In other embodiments, however, the cleaning tool can have a power distribution circuit or other suitable circuitry for receiving power (e.g., from both the electrical power lines 711*a* and 711*b*) and then distributing proper portions of the power to each component of the cleaning tool.

In the illustrated embodiment, the electrical power lines 711*a* and 711*b* are electrically coupled to the electrical connectors 703*a* and 703*b*, respectively. As shown in FIG. 8, the electrical connectors 703*a* and 703*b* can be electrically coupled to different electrical power sources A and B. In other embodiments, the portable power and water supply platform 700 can have more than two electrical connectors coupled to suitable electrical power sources individually.

Figure 9A:
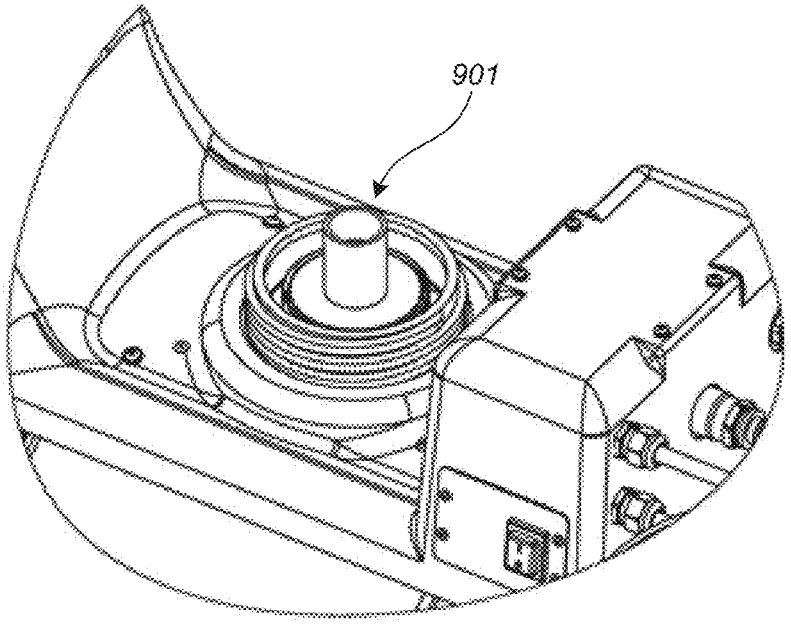
FIGS. 9A and 9B are isometric illustrations of portions of the portable power and water supply platform shown in FIG. 7A.
Figure 9B:
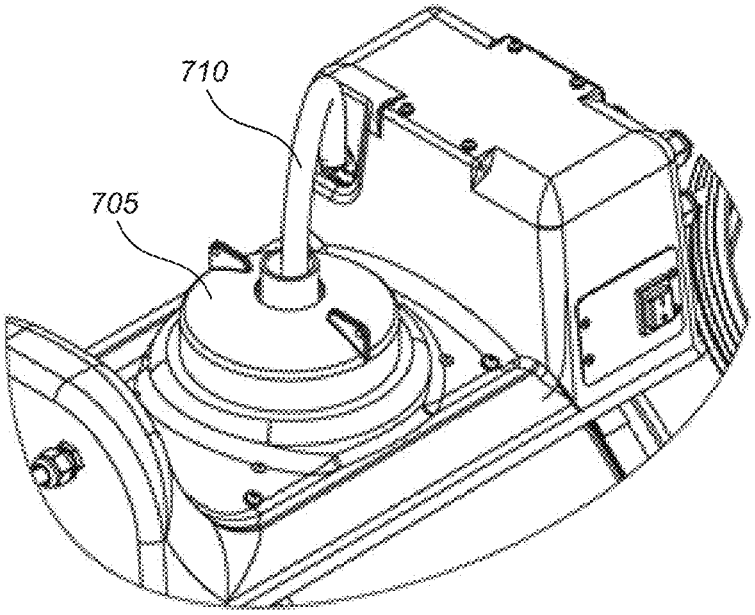

FIGS. 9A and 9B are isometric illustrations of portions of the portable power and water supply platform 700 shown in FIG. 7A. When a user wants to add fresh water to the tank 701, he/she can remove the tank cap 705 and then connect a hose or other fresh water source to a fill tube 901. When the filling process is completed, the user can place the tank cap 705 back in its original position and then slide the draw tube 710 down through and to the bottom of the fill tube 901. Alternatively, the draw tube 710 can be positioned at the bottom of the bladder 730 or the first portion of the tank 701. The draw tube 710 facilitates transporting the fresh water positioned inside the tank 701 to the fresh water outlet 707.

One feature of at least some of the foregoing embodiments is that the portable power and water supply platform 700 allows cleaning tools to be operated in places or buildings with limited or widely spaced water supplies. An advantage of this feature is that it can avoid the need for long hoses to transfer fresh water and/or waste water. Long hoses can increase friction losses, resulting an insufficient water pressure for appropriate cleaning processes. Another feature is that the portable power and water supply platform 700 allows cleaning tools to draw power from multiple power sources without the need for dragging long power cords during the cleaning process. Instead, to the extent long power cords are required to couple the cleaning tool to different power supply circuit, the cords connecting the platform to the power sources can be significantly longer than the cords connecting the platform to the cleaning tool. Because the platform is moved about less frequently than is the cleaning tool, this arrangement can be less cumbersome than existing arrangements.

From the foregoing, it will be appreciated that specific embodiments have been described herein for purposes of illustration, but that various modifications may be made without deviating from the disclosed technology. For example, in at least some embodiments, the cleaning head has nozzles that are configured to receive fluid from a spray bar; however, in other embodiments, different components such as flexible tubing can deliver the fluid. In other embodiments, a cleaning head as described herein can be configured so that fluid-supply inlet, vacuum supply inlet, and/or the flow-control inlet are arranged differently. For example, a vacuum supply inlet can be arranged toward a sidewall of the housing (rather than a top wall; see, e.g., FIG. 5A).

The methods disclosed herein include and encompass, in addition to methods of making and using the disclosed devices and systems, methods of instructing others to make and use the disclosed devices and systems. In some embodiments, such instructions may be used to teach the user how to operate a portable power and water supply system for a cleaning tool. For example, the operating instructions can instruct the user how to provide any of the operational aspects of FIGS. 7A-9B, such as controlling the flow velocity of the fresh water. In other embodiment, the operating instructions can instruct the user how to operate various aspects of the portable power and water supply 700. In some embodiments, methods of instructing such use and manufacture may take the form of computer-readable-medium-based executable programs or processes.

Moreover, aspects described in the context of particular embodiments may be combined or eliminated in other embodiments. Further, although advantages associated with certain embodiments have been described in the context of those embodiments, other embodiments may also exhibit such advantages, and not all embodiments need necessarily exhibit such advantages to fall within the scope of the presently disclosed technology.

The invention claimed is:

1. A system for supplying power and water to a cleaning tool, the system comprising:

a container including a first portion and a second portion separated from fluid communication with the first portion, wherein the first portion is configured to store fresh water, and wherein the second portion is configured to store waste water;

a handle coupled to the container, wherein the handle enables a user of the system to move the container;

a plurality of wheels coupled to the container, wherein the wheels are configured to support the container;

a first electrical connector electrically coupleable to a first electrical power source and the cleaning tool;

a second electrical connector electrically coupleable to a second electrical power source and the cleaning tool; and a flexible bladder positioned between the first portion of the container and the second portion of the container.

2. The system of claim 1, further comprising a cap positioned on the container, wherein the cap at least partially prevents water spillage from the container.

3. The system of claim 1, further comprising a draw tube partially positioned in the container and coupled to a fresh water outlet of the container.

4. The system of claim 1, wherein the container includes a fresh water inlet, a fresh water outlet, a waste water inlet, and a waste water outlet, and wherein the fresh water inlet and the waste water inlet are coupleable to the cleaning tool respectively, and wherein the fresh water inlet is coupleable to a fresh water source via a hose, and where the waste water outlet is coupleable to a drain.

5. The system of claim 1, wherein the first electrical power source provides a first amount of electrical current to a first circuit of the cleaning tool, and wherein the second electrical power source provides a second amount of electrical current to a second circuit of the cleaning tool.

6. The system of claim 5, wherein the first amount of electrical current is substantially equal to the second amount of electrical current.

7. The system of claim 1, wherein a total volume of the fresh water stored in the first portion and the waste water stored in the second portion remains constant during operation of the system.

8. The system of claim 1, wherein an amount of the fresh water stored in the first portion of the container is determined based on an operation period of the system.

9. The system of claim 1, wherein the cleaning tool includes a first circuit and a second circuit, and wherein the first electrical connector is electrically coupleable to the first circuit, and wherein the second electrical connector is electrically coupleable to the second circuit.

* * * * *